US010934805B2

(12) United States Patent
Li et al.

(10) Patent No.: US 10,934,805 B2
(45) Date of Patent: Mar. 2, 2021

(54) FRACTURING BRIDGE PLUG

(71) Applicant: Tianjin Material Technology Co., Ltd., Tian Jin. (CN)

(72) Inventors: Yicun Li, Tian Jin. (CN); Chen Chen, Tian Jin. (CN); Longchun Xue, Tian Jin. (CN); Junjie Lao, Tain Jin. (CN)

(73) Assignee: Tianjin Material Technology Co., Ltd., Tian Jin (CN)

( * ) Notice: Subject to any disclaimer, the term of this patent is extended or adjusted under 35 U.S.C. 154(b) by 0 days.

(21) Appl. No.: 16/445,602

(22) Filed: Jun. 19, 2019

(65) Prior Publication Data

US 2020/0355040 A1 Nov. 12, 2020

(30) Foreign Application Priority Data

May 10, 2019 (CN) ..... 201910387506.5
May 10, 2019 (CN) ..... 201920674995.8

(51) Int. Cl.

| | |
|---|---|
| ***E21B 33/134*** | (2006.01) |
| ***E21B 33/128*** | (2006.01) |
| ***E21B 33/129*** | (2006.01) |
| *E21B 43/26* | (2006.01) |

(52) U.S. Cl.

CPC ..... *E21B 33/134* (2013.01); *E21B 33/128* (2013.01); *E21B 33/1291* (2013.01); *E21B 43/26* (2013.01)

(58) Field of Classification Search

CPC ... E21B 33/134; E21B 33/128; E21B 33/1291
See application file for complete search history.

(56) References Cited

U.S. PATENT DOCUMENTS

| | | | | |
|---|---|---|---|---|
| 2004/0069502 | A1* | 4/2004 | Luke | E21B 33/134 166/387 |
| 2013/0299185 | A1* | 11/2013 | Xu | E21B 23/01 166/376 |
| 2018/0051532 | A1* | 2/2018 | Smith | E21B 43/26 |
| 2018/0328136 | A1* | 11/2018 | Smith | E21B 33/12 |
| 2019/0106961 | A1* | 4/2019 | Hardesty | E21B 33/1208 |

* cited by examiner

*Primary Examiner* — D. Andrews
(74) *Attorney, Agent, or Firm* — Bay State IP, LLC

(57) ABSTRACT

The present disclosure provides a fracturing bridge plug, and belongs to the technical field of downhole plugging devices of oil and gas fields, which solves technical problems that the existing packer rubber is axially compressed, a bridge plug is relatively long, and a dissolving or drilling effect is not ideal. The fracturing bridge plug comprises a cone, an upper cone, a seal assembly, a lower cone, a slip, a locking ring and a guide shoe, a matching surface of the upper cone and the seal assembly is a first ramp, one end, far away from the lower cone, of the first ramp is a large end while one end, close to the lower cone, thereof is a small end, and the diameter of the first ramp from the large end to the small end is gradually reduced.

9 Claims, 5 Drawing Sheets

FRACTURING BRIDGE PLUG

CROSS REFERENCE TO RELATED APPLICATION

This application claims priority to and takes the benefit of Chinese Patent Application No. 201920674995.8 filed on May 10, 2019 and Chinese Patent Application No. 201910387506.5 filed on May 10, 2019.

TECHNICAL FIELD

The present disclosure relates to the technical field of downhole plugging devices of oil and gas fields, and in particular, to a fracturing bridge plug.

BACKGROUND

As petroleum exploration and development is continuously deepened, unconventional hydrocarbon reservoirs with low permeability, low porosity and the like are continuously increased, the conventional vertical well cannot satisfy the development requirements, and the horizontal well gradually becomes a necessary measure for improving the comprehensive benefits of the petroleum exploration and development, wherein the horizontal well widely uses the staged fracturing technique, such technique has the advantages of once string operation, no limitation to segmentation, simple structure of a tool string, unblocked wellbore and the like, and the application of a bridge plug as one of important tools of the staged fracturing technique is daily wide.

Currently, according to the existing fracturing bridge plug, a packer rubber directly sleeves a central tube to ensure that the internal diameter and the external diameter of the packer rubber are in parallel with the axial line of the central tube, the packer rubber is under an axial extrusion force by utilizing a setting tool, slips are broken and anchored in an inner wall of a casing, and the packer rubber is extruded and sealed so as to complete the setting.

The applicant founds at least the following technical problems in the prior art: during the setting, the upper portion and the lower portion of the packer rubber need to be axially compressed at the same time, and a required bridge plug is relatively long in order to ensure the sealing effect, wherein a dissoluble bridge plug needs a long dissolution time if it is relatively long, and if a common bridge plug is relatively long, it has a long milling time and too many scraps so as to be easily blocked.

SUMMARY OF THE INVENTION

An objective of the present disclosure is to provide a fracturing bridge plug in order to solve technical problems that the existing packer rubber is axially compressed, a bridge plug is relatively long, and the solving or drilling effect is not ideal. The following describes multiple technical effects capable of being generated by a preferred technical solution of multiple technical solutions provided by the present disclosure in detail.

To achieve the above objective, the present disclosure provides the following technical solutions.

The present disclosure provides a fracturing bridge plug. The fracturing bridge plug comprises a cone, an upper cone, a seal assembly, a lower cone, a slip, a locking ring and a guide shoe, wherein the cone and the lower cone are connected and sleeve a setting mandrel, the upper cone sleeves the cone, the seal assembly sleeves the upper cone, the slip sleeves the lower cone, the slip is located between the seal assembly and the guide shoe, and the guide shoe is connected to the lower cone through the locking ring in order that the guide shoe can push the locking ring and the slip to axially move towards the upper cone; a matching surface of the upper cone and the seal assembly is a first ramp, one end, far away from the lower cone, of the first ramp is a large end while one end, close to the lower cone, thereof is a small end, and the diameter of the first ramp from the large end to the small end is gradually reduced; a matching surface of the lower cone and the slip is a second ramp, one end, close to the upper cone, of the second ramp is a large end while one end, far away from the upper cone, thereof is a small end, and the diameter of the second ramp from the large end to the small end is gradually reduced; and during setting, the cone, the upper cone and the guide shoe simultaneously relatively move and extrude the seal assembly and the slip, the seal assembly and the slip move respectively along the first ramp and a second ramp under a radial pressure towards a casing, the slip can be anchored in an inner wall of the casing due to the radial pressure, and the seal assembly is tightly clung to the inner wall of the casing, thereby forming a seal between the bridge plug and the casing.

Preferably, an inclination angle of the first ramp and an inclination angle of the second ramp are equal in a range of 12 degrees to 20 degrees.

Preferably, a compensation clearance is arranged between the upper cone and the lower cone, and the axial length of the compensation clearance is in a range of 0.5 mm to 2 mm.

Preferably, the lower cone and the locking ring are connected through a first one-way locking mechanism in order to prevent the locking ring from moving away from the seal assembly, and the locking ring and the guide shoe are connected through a second one-way locking mechanism in order that the guide shoe can push the locking ring and the slip to move towards the seal assembly.

Preferably, the seal assembly comprises a packer rubber, an inner back-up ring, and an outer back-up ring, all of which are sequentially arranged, the packer rubber is propped against the inner back-up ring, the inner back-up ring is clamped with the outer back-up ring, and the slip is connected to the outer back-up ring and the guide shoe through radial limiting mechanisms.

Preferably, the radial limiting mechanisms comprise limiting bulges and limiting grooves, the limiting bulges are arranged at two ends of the slip, the limiting grooves are respectively arranged on the outer back-up ring and the guide shoe, and the limiting grooves and the limiting bulges are connected in a matching manner in order to limit the radial rotation of the slip and the guide shoe and the radial rotation of the slip and the seal assembly.

Preferably, the lower cone is connected to the slip and the guide shoe through a chute mechanism, and the chute mechanism comprises guide shoe inner grooves axially arranged on the guide shoe, slip inner grooves axially arranged on the slip and pawls arranged at the end portion of the lower cone, wherein the pawls, the slip inner grooves and the guide shoe inner grooves are sequentially connected in the matching manner in order that the guide shoe and the slip can only axially move along the lower cone.

Preferably, a plurality of variable-diameter inner bulges are arranged at the interior of one end, away from the cone, of the guide shoe, and the variable-diameter inner bulges are propped against the setting mandrel in the matching manner.

Preferably, fastening pins are arranged at a joint of the cone and the lower cone and between the guide shoe and the locking ring.

Preferably, ceramic teeth are arranged on the surface of the guide shoe.

The present disclosure relates to the fracturing bridge plug. As compared with the prior art, the present disclosure has the following beneficial effects:

according to the fracturing bridge plug provided by the present disclosure, the matching surface of the upper cone and the seal assembly and the matching surface of the lower cone and the slip are configured to ramps, so the seal assembly and the slip obliquely move respectively along the first ramp and the second ramp when being extruded, and at this time, the first ramp and the second ramp generate radial extrusion forces towards the casing to the seal assembly and the slip; and the radial movement distance of the seal assembly towards the casing is the fixed value, so, due to the existence of the inclination angles, the axial movement distance of the seal assembly is smaller, that is, the compression distance of two ends of the bridge plug is reduced, thereby reducing the length of the bridge plug, shortening a dissolution time or a milling time, and reducing the scraps.

BRIEF DESCRIPTION OF THE DRAWINGS

To describe the technical solutions in the embodiments of the present disclosure or in the prior art more clearly, the following briefly describes the accompanying drawings required for describing the embodiments or the prior art. Apparently, the accompanying drawings in the following description show some embodiments of the present disclosure, and a person of ordinary skill in the art may still derive other drawings from these accompanying drawings without creative efforts.

Figure 1:
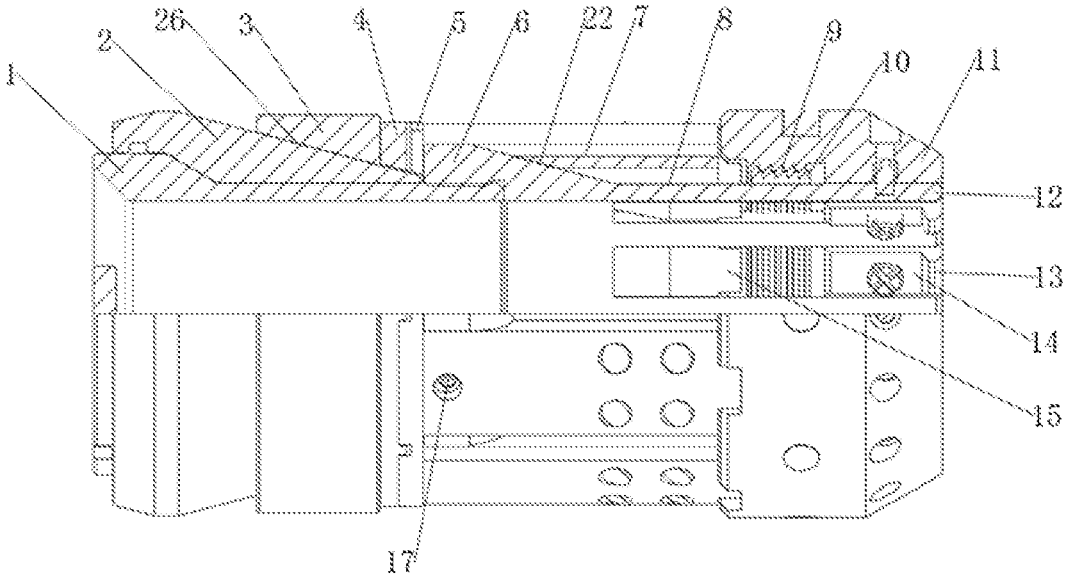
FIG. 1 is a schematic structural diagram of the present disclosure.

In the drawings: 1—cone, 2—upper cone, 3—packer rubber, 4—inner back—up ring, 5—outer back—up ring, 6—lower cone, 7—slip, 8—first one—way locking mechanism, 9—second one—way locking mechanism, 10—locking ring, 11—guide shoe, 12—pawl, 13—variable—diameter inner bulge, 14—guide show inner groove, 15—slip inner groove, 16—setting mandrel, 17—fastening pin, 18—inclination angle, 19—spring pin, 20—O-ring, 21—compensation clearance, 22—second ramp, 23—relatively large object, 24—setting push drum, 25—connecting sleeve, 26—first ramp, 27—ceramic tooth, 28-releasing pin, A-radial compression direction of the packer rubber, B-pressure, and C-pressure transfer ramp.

DETAILED DESCRIPTION OF THE SEVERAL EMBODIMENTS

To make the objectives, technical solutions, and advantages of the present disclosure clearer, the following describes the technical solutions of the present disclosure in detail. Apparently, the described embodiments are merely a part rather than all of the embodiments of the present disclosure. All other embodiments obtained by a person of ordinary skill in the art based on the embodiments of the present disclosure without creative efforts shall fall within the protection scope of the present disclosure.

In the description of the present disclosure, it should be understood that orientations or position relationships indicated by terms "center", "lateral", "length", "width", "height", "upper", "lower", "front", "back", "left", "right", "vertical", "horizontal", "top", "bottom", "inside", "outside" and "side", etc. are orientations or position relationships as shown in FIG. 1, and these terms are just used to facilitate description of the present disclosure and simplify the description, but not to indicate or imply that the mentioned apparatus or elements must have a specific orientation and must be established and operated in a specific orientation, and thus, these terms cannot be understood as a limitation to the present disclosure.

As shown in FIG. 1 to FIG. 9, the present disclosure provides a fracturing bridge plug. The fracturing bridge plug comprises a cone 1, an upper cone 2, a seal assembly, a lower cone 6, a slip 7, a locking ring 10 and a guide shoe 11, wherein the cone 1 and the lower cone 6 are connected and sleeve a setting mandrel 16, the upper cone 2 sleeves the cone 1, the seal assembly sleeves the upper cone 2, the slip 7 sleeves the lower cone 6, the slip 7 is located between the seal assembly and the guide shoe 11, and the guide shoe 11 is connected to the lower cone 6 through the locking ring 10 in order that the guide shoe 11 can push the locking ring 10 and the slip 7 to axially move towards the upper cone 2; the slip 7 is connected to the seal assembly and the guide shoe 11 through radial limiting mechanisms; a matching surface of the upper cone 2 and the seal assembly is a first ramp 26, one end, far away from the lower cone 6, of the first ramp 26 is a large end while one end, close to the lower cone 6, thereof is a small end, and the diameter of the first ramp 26 from the large end to the small end is gradually reduced; a matching surface of the lower cone 6 and the slip 7 is a second ramp 22, one end, close to the upper cone 2, of the second ramp 22 is a large end while one end, far away from the upper cone 2, thereof is a small end, and the diameter of the second ramp 22 from the large end to the small end is gradually reduced; and during setting, the cone 1, the upper cone 2 and the guide shoe 11 simultaneously relatively move and extrude the seal assembly and the slip 7, the seal assembly and the slip 7 move respectively along the first ramp 26 and a second ramp 22 under a radial pressure towards a casing, the slip 7 can be anchored in an inner wall of the casing due to the radial pressure, and the seal assembly is tightly clung to the inner wall of the casing, thereby forming a seal between the bridge plug and the casing.

Figure 2:
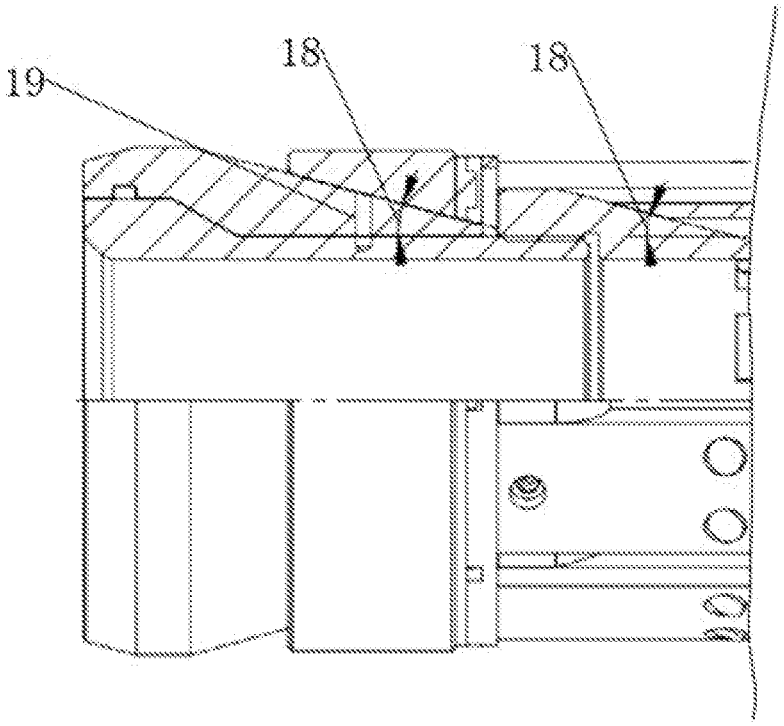
FIG. 2 is a schematic structural diagram of inclination angles according to the present disclosure.

In the present disclosure, one end close to the cone 1 is an upper end, one end close to the guide shoe 11 is a lower end, and during setting, the cone 1 and the upper cone 2 move downwards and the guide shoe 11 moves upwards in order to extrude the seal assembly and the slip 7; a direction in parallel with an axial line of the setting mandrel 16 is an axial direction, and a movement direction vertical to the axial direction is a radial direction, wherein a movement direction of the seal assembly on the first ramp 26 is an oblique movement direction, the oblique movement direction can be divided into an axial movement direction and a radial movement direction towards the casing, as shown in FIG. 2, the tangential value of an inclination angle 18 of the first ramp 26 is equal to a ratio of the movement height of the seal assembly in the radial direction to the movement distance thereof in the axial direction; the existing seal assembly has a cylindrical structure, and its inclination angle 18 is 0 degree, so a compression distance of the axial movement should be large in order to ensure the sealing effect; but in the present disclosure, the inclination angle 18 exists, and the radial movement distance of the seal assembly towards the casing is a fixed value, so the axial movement distance of the corresponding seal assembly is smaller, that is, the integral length of the bridge plug is reduced; the cone 1 and the lower cone 6 are in threaded connection, a spring pin 19 is arranged between the upper cone 2 and the cone 1 to secure their positions, and an O-ring 20 is also arranged between the upper cone 2 and the cone 1; and due to the radial limiting mechanisms, the slip 7, the seal assembly and the guide shoe 11 can only move up and down but not rotate relatively.

Figure 3:
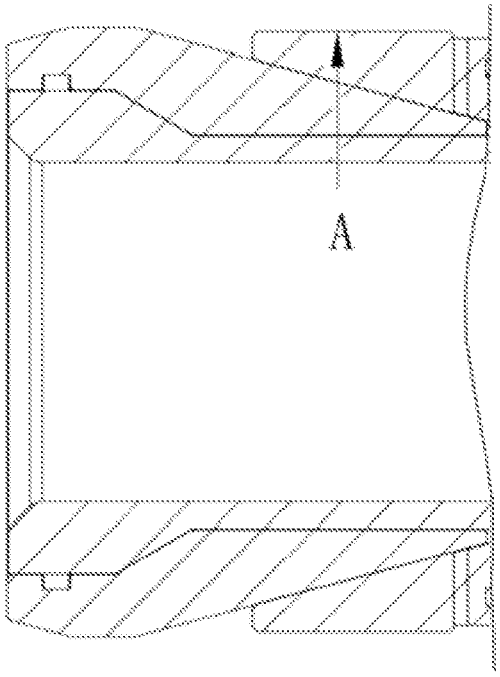
FIG. 3 is a schematic diagram of a compression direction of a packer rubber according to the present disclosure.

The matching surface of the upper cone 2 and the seal assembly and the matching surface of the lower cone 6 and the slip 7 are configured to ramps so as to form a biconical structure, so the seal assembly and the slip 7 obliquely move respectively along the first ramp 26 and the second ramp 22 when being extruded, and at this time, the first ramp 26 and the second ramp 22 generate radial extrusion forces towards the casing to the seal assembly and the slip 7, referring to a direction A in FIG. 3; and the radial movement distance of the seal assembly towards the casing is the fixed value, so, due to the existence of the inclination angles 18, the axial movement distance of the seal assembly is smaller, that is, the compression distance of two ends of the bridge plug is reduced, thereby reducing the length of the bridge plug, shortening a dissolution time or a milling time, and reducing the scraps.

As an optional embodiment, the inclination angle 18 of the first ramp 26 and the inclination angle 18 of the second ramp 22 are equal in a range of 12 degrees to 20 degrees.

An optimal angle for sealing and anchoring is in the range of 12 degrees to 20 degrees. If the inclination angle 18 is overlarge, an expansion force of the packer rubber 3 is increased when the packer rubber 3 of the seal assembly is extruded, and an overlarge expansion force is easy to cause incomplete seal of the packer rubber 3; and if the inclination angle 18 is too small, because the radial movement distance of the packer rubber 3 towards the casing is the fixed value, the smaller the inclination angle 18 is, the larger the axial movement distance of the packer rubber 3 is, thereby increasing the length of the whole bridge plug, prolonging the dissolution time and the drilling time of the dissoluble or common bridge plug and causing many scraps.

Figure 4:
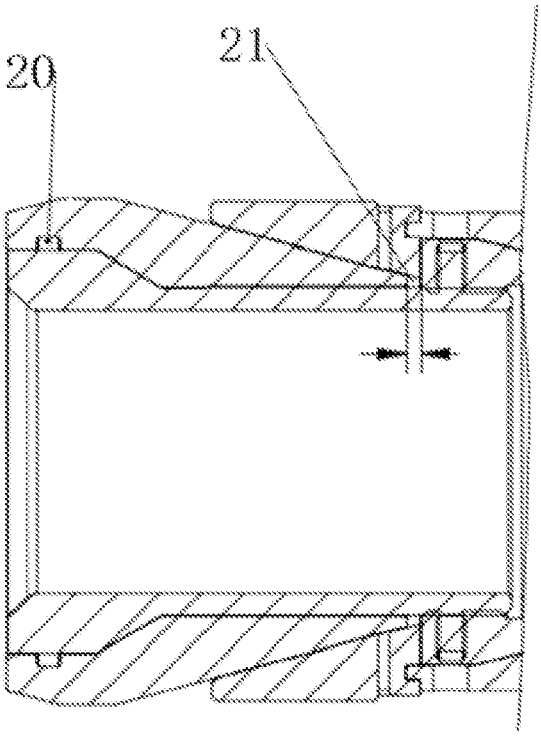
FIG. 4 is a schematic diagram of a compensation distance according to the present disclosure.

As an optional embodiment, as shown in FIG. 4, a compensation clearance 21 is arranged between the upper cone 2 and the lower cone 6, and the axial length of the compensation clearance 21 is in a range of 0.5 mm to 2 mm.

When the bridge plug bears the pressure, the upper cone moves downwards, its movement distance is the compensation clearance 21, the bridge plug self has a pressure compensation effect due to the compensation clearance 21, and the packer rubber 3 can be further compressed, so the compression of the packer rubber 3 is more complete. An optimal compensation range of the packer rubber 3 is the range of 0.5 mm to 2 mm. If the compensation distance is too small, the extrusion force is insufficient so that a seal reinforcing function cannot be achieved; and if the compensation distance is overlarge, the ramp of the upper cone 2 props against an inner back-up ring 4 and an outer back-up ring 5, the inner back-up ring 4 and the outer back-up ring 5 need to resist the extrusion of the packer rubber 3, and if the movement distance of the upper cone 2 is overlarge, the inner back-up ring 4 and the outer back-up ring 5 are extruded to be broken and worn and then cannot ensure an extrusion resistance to the packer rubber 3, so, when the upper cone 2 moves downwards, a contact problem of the inner diameters of the inner back-up ring 4 and the outer back-up ring 5 with the upper cone 2 should be considered in order to avoid that the inner back-up ring 4 and the outer back-up ring 5 are locked due to the overlarge movement distance of the upper cone 2 and adverse effects to the seal are generated.

As an optional embodiment, the lower cone 6 and the locking ring 10 are connected through a first one-way locking mechanism 8 in order to prevent the locking ring 10 from moving away from the seal assembly, and the locking ring 10 and the guide shoe 11 are connected through a second one-way locking mechanism 9 in order to ensure that the guide shoe 11 can push the locking ring 10 and the slip 7 to move towards the seal assembly.

Specifically, the first one-way locking mechanism 8 comprises a first sawtooth arranged on the lower cone 6 and a first matching tooth matching with the first sawtooth to perform transmission, its locking direction is a direction along the axial direction of the setting mandrel 16 and towards the guide shoe 11, that is, the guide shoe 11 drives the locking ring 10 to be only capable of moving upwards, and the first one-way locking mechanism 8 prevents the locking ring 10 and the guide shoe 11 from moving downwards so as to be capable of preventing the slip 7 from axially moving downwards; and the second one-way locking mechanism 9 comprises a second sawtooth arranged on the locking ring 10 and a second matching tooth arranged on the guide shoe 11 and matching with the second sawtooth, its locking direction is a direction along the axial direction of the setting mandrel 16 and away from the guide shoe 11, so, due to the second one-way locking mechanism 9 in the setting procedure, the guide shoe 11 can push the locking ring 10 and the slip 7 to move upwards along the first one-way locking mechanism 8. The first one-way locking mechanism 8 and the second one-way locking mechanism 9 are matched so as to have a simple structure and be convenient in operation.

As an optional embodiment, the seal assembly comprises the packer rubber 3, the inner back-up ring 4 and the outer back-up ring 5, all of which are sequentially arranged, the packer rubber 3 is propped against the inner back-up ring 4, the inner back-up ring 4 is clamped with the outer back-up ring 5, and the slip 7 is connected to the outer back-up ring 5 and the guide shoe 11 through the radial limiting mechanisms.

Specifically, a clamping structure comprises a recesses and a protrusion, the both are in matching connection, the inner back-up ring 4 and the outer back-up ring 5 are respectively and radially grooved, and grooves opened in the inner back-up ring 4 and the outer back-up ring 5 are uniformly staggered and clamped during assembling in order that fracture positions are uniformly staggered when the inner back-up ring 4 and the outer back-up ring 5 are fractured; and due to the radial limiting mechanisms, the seal assembly and the slip 7 can only do axial movement, wherein the radial limiting mechanisms comprise limiting bulges and limiting grooves, the limiting bulges are arranged at two ends of the slip 7, the limiting grooves are respectively arranged on the outer back-up ring 5 and the guide shoe 11, and the limiting grooves and the limiting bulges are connected in a matching manner in order to limit the radial rotation between the slip 7 and the guide shoe 11 and between the slip 7 and the seal assembly.

As an optional embodiment, the lower cone is connected to the slip 7 and the guide shoe 11 through a chute mechanism, and the chute mechanism comprises guide shoe inner grooves 14 axially arranged on the guide shoe 11, slip inner grooves 15 axially arranged on the slip 7 and pawls 12 arranged at the end portion of the lower cone 6, wherein the pawls 12, the slip inner grooves 15 and the guide shoe inner grooves 14 are sequentially connected in the matching manner in order that the guide shoe 11 and the slip 7 can only axially move along the lower cone 6.

Figure 5:
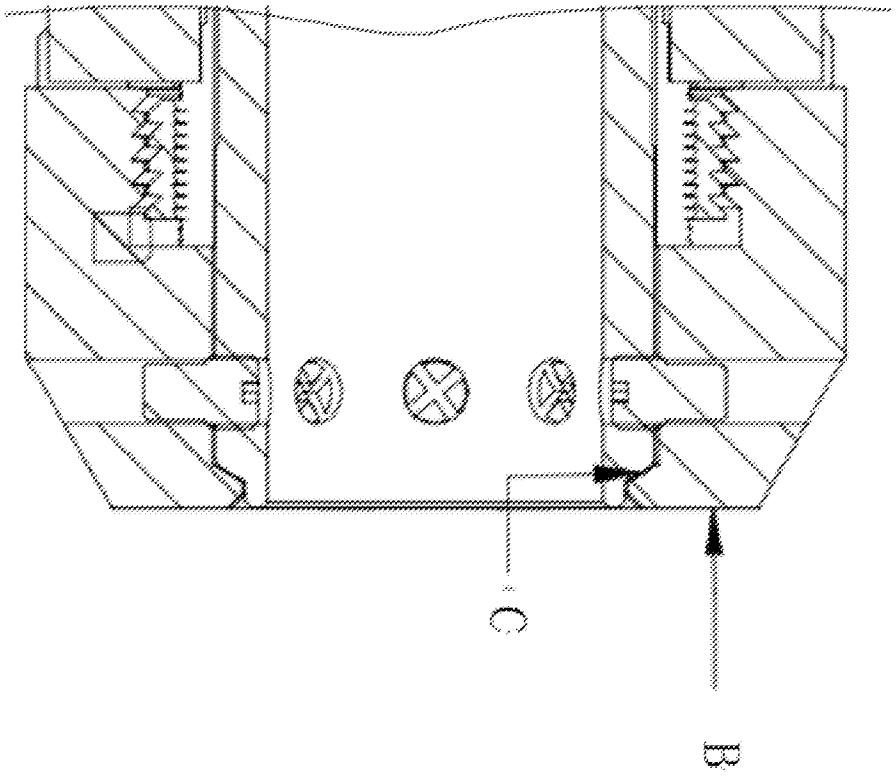
FIG. 5 is a schematic diagram of pressure transfer at the moment of meeting blockage when the fracturing bridge plug of the present disclosure descends down the hole.
Figure 6:
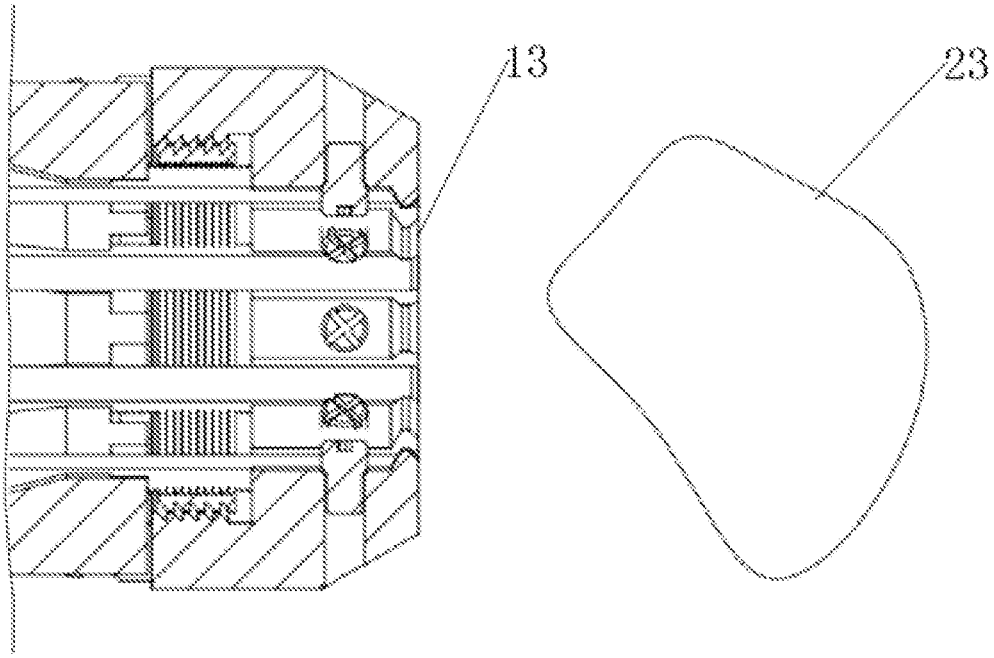
FIG. 6 is a schematic diagram of a fact when the fracturing bridge plug of the present disclosure meets a relatively large object.

As an optional embodiment, a plurality of variable-diameter inner bulges 13 are arranged at the interior of one end, away from the cone, of the guide shoe 11, the variable-diameter inner bulges 13 are propped against the setting mandrel 16 in the matching manner in order to prevent a relatively large object 23 from entering the interior of the bridge plug to cause blockage during production and to ensure the smoothness of the interior of the bridge plug; and meanwhile, if the bridge plug is blocked when descending down the hole, a pressure B can be transferred to the setting mandrel 16 through a pressure transfer ramp C so as to avoid advance setting of the bridge plug, as shown in FIG. 5 and FIG. 6.

As an optional embodiment, fastening pins are arranged at a joint of the cone 1 and the lower cone 6 and between the guide shoe 11 and the locking ring 10; as shown in FIG. 1, the fastening pin 17 is arranged at a threaded joint in order to prevent the cone 1 and the lower cone 6 from generating radial rotation; correspondingly mounting holes are formed in the slip 7 and match with the fastening pins to mount; and the fastening pins between the guide shoe 11 and the locking ring 10 are also arranged like the above, which are not shown in the drawings.

Figure 8:
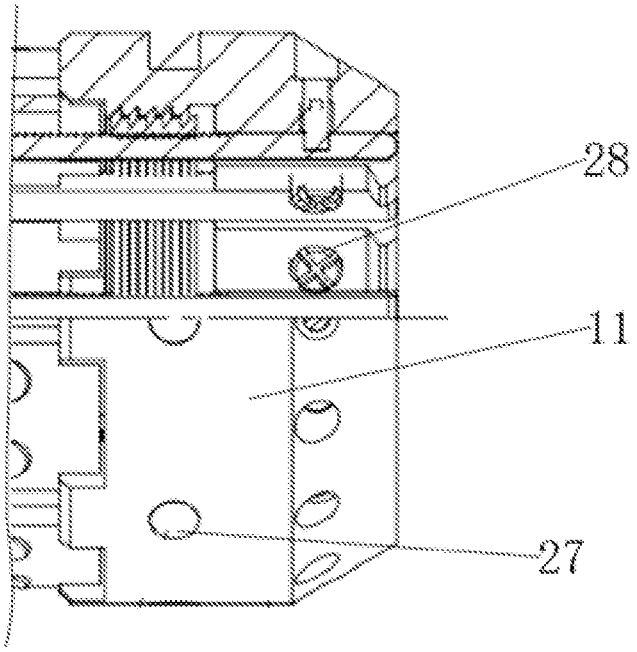
FIG. 8 is a schematic diagram of a downhole wear-resisting structure of the present disclosure.

As an optional embodiment, as shown in FIG. 8, ceramic teeth 27 are arranged on the surface of the guide shoe 11 and can achieve an effective wear resisting function when the bridge plug descends down the hole.

Figure 7:
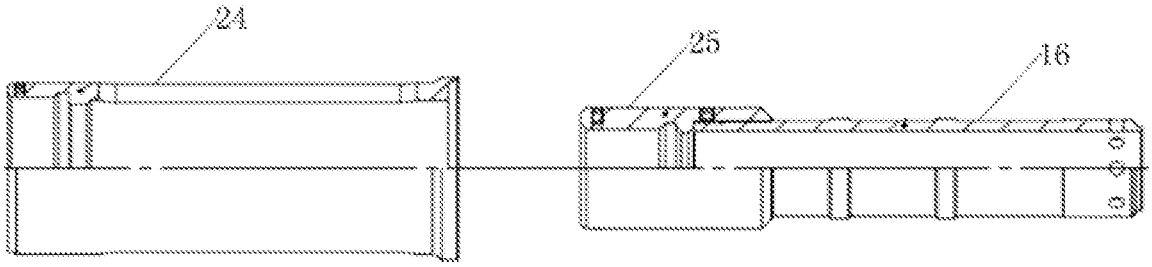
FIG. 7 is a schematic diagram of a utilized releasing mechanism in use according to the present disclosure.
Figure 9:
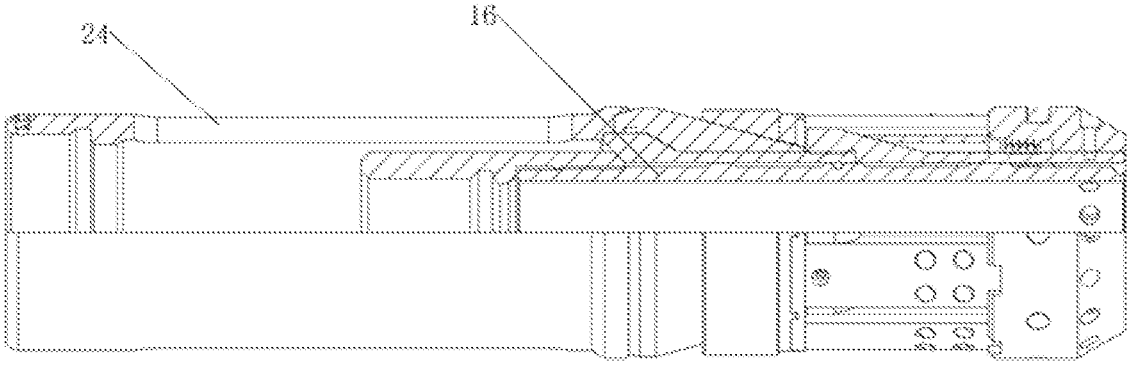
FIG. 9 is a semi-sectional schematic diagram of a setting joint according to the present disclosure.

The working process of the fracturing bridge plug provided by the present disclosure:

in use, firstly explosive powder or a hydraulic setting tool is connected to the fracturing bridge plug, the fracturing bridge plug is conveyed to an appointed position of a wellbore by utilizing cables or a coiled tubing, a setting tool starts by exploding the explosive powder or in other manners, and the setting tool is connected to the setting mandrel 16 through a connecting sleeve 25; because the pressure of the setting tool is acted on a setting push drum 24, the setting push drum 24 pushes the cone 1 and the upper cone 2 to move downwards, the setting mandrel 16 and the setting push drum 24 move relatively, the upper cone 2 moves downwards, simultaneously compresses the packer rubber 3 and expands the inner back-up ring 4 and the outer back-up ring 5, and the slip 7 is fractured when the pressure is up to a certain value; and when the pressure is up to a shearing value of each releasing pin 28, the releasing pins 28 are sheared off, the inner back-up ring 4 and the outer back-up ring 5 are completely expanded, the packer rubber 3 is compressed to a maximum compression amount, and the slip 7 is anchored in the inner wall of the casing, thereby completing the setting, as shown in FIG. 7 and FIG. 9. The cables are lifted upwards to drive a perforating gun to move, the perforating gun ignites and perforates after reaching the appointed position, the perforating gun, the setting tool and the like are taken out after perforation is completed, balls are injected to perform a fracturing operation, and after the fracturing operation is completed, the bridge plug can be dissolved by self or is drilled.

The above merely describes specific embodiments of the present disclosure, but the protection scope of the present disclosure is not limited thereto. A person skilled in the art can easily conceive modifications or replacements within the technical scope of the present disclosure, and these modifications or replacements shall fall within the protection scope of the present disclosure. Therefore, the protection scope of the present disclosure should be subject to the protection scope of the claims.

What is claimed is:

1. A fracturing bridge plug, characterized by comprising a cone (1), an upper cone (2), a seal assembly, a lower cone (6), a slip (7), a locking ring (10) and a guide shoe (11), wherein the cone (1) and the lower cone (6) are connected and sleeve a setting mandrel (16), the upper cone (2) sleeves the cone (1), the seal assembly sleeves the upper cone (2), the slip (7) sleeves the lower cone (6), the slip (7) is located between the seal assembly and the guide shoe (11), and the guide shoe (11) is connected to the lower cone (6) through the locking ring (10) in order that the guide shoe (11) can push the locking ring (10) and the slip (7) to axially move towards the upper cone (2);

a matching surface of the upper cone (2) and the seal assembly is a first ramp (26), one end, being on an opposite end from the lower cone (6), of the first ramp (26) is a relatively larger end while one end, on the closest side to the lower cone (6), thereof is a relatively smaller end, and the diameter of the first ramp (26) from the large end to the small end is gradually reduced; a matching surface of the lower cone (6) and the slip (7) is a second ramp (22), one end, close to the upper cone (2), of the second ramp (22) is a large end while one end, far away from the upper cone (2), thereof is a small end, and the diameter of the second ramp (22) from the large end to the small end is gradually reduced; and during setting, the cone (1), the upper cone (2) and the guide shoe (11) simultaneously relatively move and radially extrude the seal assembly and the slip (7), so that the slip (7) is anchored in an inner wall of a casing, and the seal assembly is tightly clung to the inner wall of the casing, thereby forming a seal between the bridge plug and the casing.

2. The fracturing bridge plug according to claim 1, characterized in that an inclination angle of the first ramp (26) and an inclination angle of the second ramp (22) are equal in a range of 12 degrees to 20 degrees.

3. The fracturing bridge plug according to claim 1, characterized in that a compensation clearance (21) is arranged between the upper cone (2) and the lower cone (6), and the axial length of the compensation clearance (21) is in a range of 0.5 mm to 2 mm.

4. The fracturing bridge plug according to claim 1, characterized in that the lower cone (6) and the locking ring (10) are connected through a first one-way locking mechanism (8) in order to prevent the locking ring (10) from moving away from the seal assembly, and the locking ring (10) and the guide shoe (11) are connected through a second one-way locking mechanism (9) in order that the guide shoe (11) can push the locking ring (10) and the slip (7) to move towards the seal assembly.

5. The fracturing bridge plug according to claim 1, characterized in that the seal assembly comprises a packer rubber (3), an inner back-up ring (4) and an outer back-up ring (5), all of which are sequentially arranged, the packer rubber (3) is propped against the inner back-up ring (4), the inner back-up ring (4) is clamped with the outer back-up ring (5), and the slip (7) is connected to the outer back-up ring (5) and the guide shoe (11) through radial limiting mechanisms.

6. The fracturing bridge plug according to claim 1, characterized in that the lower cone (6) is connected to the slip (7) and the guide shoe (11) through a chute mechanism, and the chute mechanism comprises guide shoe inner grooves (14) axially arranged on the guide shoe (11), slip inner grooves (15) axially arranged on the slip (7) and pawls (12) arranged at the end portion of the lower cone (6), wherein the pawls (12), the slip inner grooves (15) and the guide shoe inner grooves (14) are sequentially connected in the matching manner in order that the guide shoe (11) and the slip (7) can only axially move along the lower cone (6).

7. The fracturing bridge plug according to claim 1, characterized in that a plurality of variable-diameter inner bulges (13) are arranged at the interior of one end, away from the cone (1), of the guide shoe (11), and the variable-diameter inner bulges (13) are propped against the setting mandrel (16) in the matching manner.

8. The fracturing bridge plug according to claim 1, characterized in that fastening pins are arranged at a joint of the cone (1) and the lower cone (6) and between the guide shoe (11) and the locking ring (10).

9. The fracturing bridge plug according to claim 1, characterized in that ceramic teeth (27) are arranged on the surface of the guide shoe (11).

* * * * *